US005130604A

United States Patent [19]

Franks, Jr. et al.

[11] Patent Number: 5,130,604

[45] Date of Patent: Jul. 14, 1992

[54] MINIATURE INCANDESCENT LAMP WITH CURABLE ELECTRICALLY CONDUCTIVE ADHESIVE

[75] Inventors: George J. Franks, Jr., 664 Thompson Cir., Inverness, Ill. 60067; Joseph J. Glavan, Jr., Arlington Heights, Ill.

[73] Assignee: George J. Franks, Jr., Inverness, Ill.

[21] Appl. No.: 642,753

[22] Filed: Jan. 18, 1991

[51] Int. Cl.[5] ..... H01K 1/24

[52] U.S. Cl. ..... 313/580; 313/315; 313/318; 313/331; 313/624; 313/634; 439/611

[58] Field of Search ..... 313/315, 318, 331, 580, 313/624, 634; 439/611, 617, 618, 226, 230

[56] References Cited

U.S. PATENT DOCUMENTS

| | | | |
|---|---|---|---|
| 3,274,426 | 9/1966 | Scoledge et al. | 313/318 |
| 3,413,054 | 11/1968 | Richards et al. | 313/315 X |
| 3,448,320 | 6/1969 | Millikan | 313/318 X |
| 4,119,832 | 10/1978 | Audesse et al. | 313/315 X |
| 4,680,505 | 7/1987 | Funada et al. | 313/634 X |
| 4,918,355 | 4/1990 | Morris et al. | 313/318 |
| 4,952,838 | 8/1990 | DuNah | 313/318 |
| 4,970,428 | 11/1990 | Hayakawa et al. | 313/318 |

*Primary Examiner*—Donald J. Yusko
*Assistant Examiner*—Ashok Patel
*Attorney, Agent, or Firm*—Jenner & Block

[57] ABSTRACT

A miniature surface mount style lamp is disclosed which can be assembled relatively quickly, easily and inexpensively. A pair of closed metal end caps are conductively adhered to the opposed ends of a bulb envelope having a pair of exposed filament leads protruding from either end. In some embodiments, the filament leads are in physical contact with the end caps. In other embodiments, the electrical connection between the end caps and the filament leads is provided only by the conductive adhesive.

19 Claims, 1 Drawing Sheet

MINIATURE INCANDESCENT LAMP WITH CURABLE ELECTRICALLY CONDUCTIVE ADHESIVE

FIELD OF THE INVENTION

This invention relates to miniature incandescent bulbs. More particularly, the invention relates to miniature incandescent bulbs having metal end caps on opposing ends for providing electrical contact and allowing the bulbs to be soldered to or replaceably mounted in lamp holders. The bulbs are especially suited for use in miniature pagers, telephones, radios or other small electronic devices having illuminated buttons, switches or displays.

BACKGROUND OF THE INVENTION

Modern electronic technology continues to provide consumers with an ever expanding variety of miniature or portable electronic devices. Examples of these devices include communications devices such as portable cellular telephones, pocket pagers or radio transceivers as well as entertainment devices such as portable AM/FM radios or tape players. Because these devices are intended for around the clock use, various switches and displays must be illuminated to permit equipment operation at night or in poorly illuminated areas.

Miniature incandescent bulbs have been and continue to be a relatively reliable and cost effective method of illuminating displays or controls needed for the operation of portable electronic equipment. Because most portable equipment is battery powered, the miniature bulbs are usually low voltage, direct current devices powered directly or indirectly by the equipment batteries.

The portable nature of modern electronic equipment subjects miniature incandescent bulbs to shocks and vibrations which tend to reduce the effective life of miniature incandescent bulbs below the finite life expectancy inherently associated with miniature incandescent devices. Therefore, portable electronic equipment is typically manufactured in such a manner as to permit easy bulb replacement. One bulb configuration permitting easy bulb replaceability is a miniature surface mount bulb in which a generally elongated bulb envelope includes a metal end cap at each end of the bulb envelope. The end caps are designed to be tensionably or otherwise retained by a pair of complementary socket elements or solder terminals which provide an electrical connection between the bulb filament and the bulb socket elements or solder terminals.

While various designs for miniature incandescent bulbs are known, many of these designs are relatively expensive and cumbersome to manufacture. For example, prior art devices such as those illustrated in U.S. Pat. No. 4,952,838 to DuNah teach lamp structure having open metal end caps through which the bulb filament must be threaded prior to soldering or otherwise electrically securing the filament to the metal end caps. Other miniature lamp designs utilize an end cap having a small hole at the end through which the filament must be threaded, which is even more difficult to assemble than for the lamp of DuNah. Manipulative steps such as this tend to increase bulb costs, thereby leading to higher equipment prices or a reduction in the use of bulbs from what could otherwise be afforded if a cheaper miniature surface mount lamp device was available. Accordingly, a need exists for a miniature surface mount lamp that can be constructed more easily and inexpensively.

SUMMARY OF THE INVENTION

In accordance with the present invention, a surface mount lamp is provided which can be manufactured quickly and inexpensively.

In one embodiment, a generally elongated bulb envelope or body surrounds and encloses a portion of an incandescent bulb filament. Filament leads extend from opposing ends of the elongated envelope. Structure is provided for electrically connecting each filament lead to a respective one of the end caps. Structure is also provided for physically connecting each end cap to its associated envelope end. For example, in one embodiment, a layer of electrically conductive adhesive is used to electrically connect the filament leads to complementary metal end caps fitted over each envelope end. The adhesive also provides a physical or mechanical connection between the envelope and the end caps. In some embodiments, the filament leads can make direct electrical contact with the end caps. A material, such as an adhesive, for example, which may be electrically conducting or non-electrically conducting may be used to provide a mechanical or physical connection of the end caps to the envelope ends. Typically, if a non-electrically conducting material is used to physically connect the end caps to the bulb envelope, the filament leads will be directly connected to the metal end caps, such as by soldering, for example. Other structure may be used to connect the leads to the end caps, as desired. In other embodiments, each filament lead is disposed between the lamp body and a different one of the metal end caps and can extend beyond the inner end of the associated metal end cap and the protruding leads are folded back and soldered or otherwise electrically connected to an outer surface of the end cap.

In another embodiment, a sealed cylindrical incandescent bulb includes a filament having filament leads extending from each end of the cylindrical bulb envelope. Complementary cylindrical metal end caps each have a closed end and an open end for fitting over the cylindrical envelope ends. An electrically conductive adhesive is used to electrically connect the filament leads to the metal end caps while at the same time providing a mechanical bond between the metal end caps and the cylindrical envelope. In some embodiments, the electrically conductive adhesive substantially fills the volume located between the inner surfaces of the end caps and the envelope ends. In other embodiments, each filament lead is disposed between the lamp body and a different one of the metal end caps and can extend beyond the inner end of the associated metal end cap and the leads are folded back on and soldered to the end caps.

In another embodiment, structure is provided for generating incandescent illumination when electric current is applied to two exposed filament leads located at generally opposite ends of a bulb envelope. End cap structure is conductively adhered to the opposing bulb ends and exposed filament leads to permit connection to an electric circuit.

In accordance with the invention, a method is provided for producing a miniature incandescent surface mount lamp by applying an electrically conductive adhesive between metal end caps over the ends of a bulb envelope having exposed filament leads located at the envelope ends. The filament leads become disposed in the electrically conductive adhesive so that the adhesive electrically connects the end caps to the filament leads.

In accordance with the disclosed embodiments of the invention, a miniature surface mount incandescent lamp is provided which can be assembled relatively easily and inexpensively.

In accordance with another embodiment of the invention, a miniature surface mount style incandescent lamp can be constructed without having to thread a filament through an aperture in a metallic end cap.

In accordance with other embodiments of the invention, a miniature incandescent surface mount style lamp is provided which does not require precise orientation or soldering of the bulb filament leads during assembly.

DETAILED DESCRIPTION OF THE INVENTION

Several embodiments of a miniature incandescent fuse lamp in accordance with the invention are illustrated in FIGS. 1–4. In each of these FIGURES, in which like numerals refer to like parts, a cylindrical lamp envelope or body is shown in conjunction with cylindrical metal end caps. The lamp envelope, however, can be any desired generally elongated shape and the end caps can be any desired shape having a complementary open end capable of receiving the ends of the lamp envelope. In each of the disclosed embodiments, the use of an electrically conductive adhesive to join the bulb envelope, end caps and filament leads reduces or eliminates the need for time consuming or otherwise expensive filament lead orientation during the assembly process.

Figure 1:
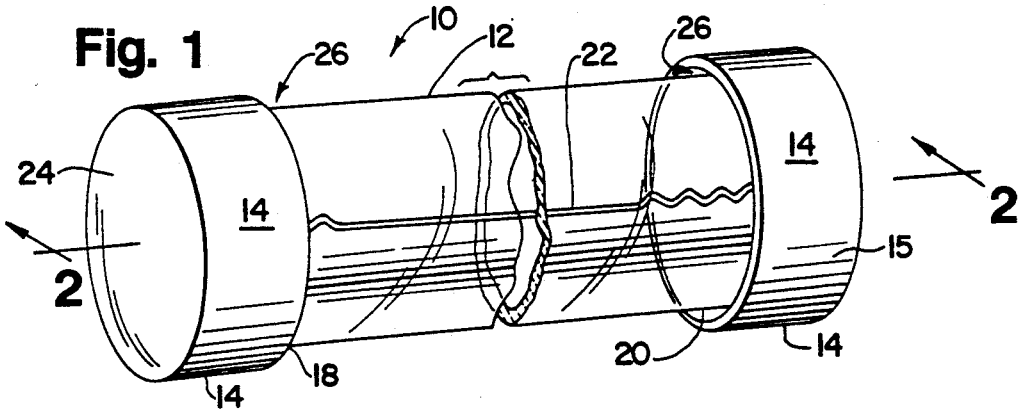
FIG. 1 is a perspective view of a miniature fuse lamp constructed in accordance with one embodiment of the invention.

FIG. 1 is a perspective view of one embodiment of a miniature incandescent lamp 10 constructed in accordance with one embodiment of the invention. Lamp 10 is composed of a cylindrical lamp envelope or body 12, a pair of cup-shaped cylindrical metal end caps 14 and electrically conductive adhesive 16 (illustrated in FIG. 2) for securing cups 14 to the ends of lamp envelope 12 as hereinafter described.

Lamp envelope 12 includes opposed envelope ends 18 and 20, an incandescent bulb filament illuminating portion 22 axially disposed along the center of lamp envelope 12 and filament leads 23 extend through ends 18 and 20. Filament 22 provides incandescent illumination when an electric current is applied across it. Filament 22 and lamp envelope 12 can be constructed from any of several bulb construction materials well known in the incandescent bulb art. In a typical embodiment, lamp 10 has an overall length of about 0.25 inches, an envelope 12 outside diameter of about 0.037 inches, and end caps 14 having a length of about 0.05 inches and a diameter of about 0.05 inches.

While the invention is described with respect to incandescent illumination, it is to be understood that the invention is applicable to non-incandescent illumination. For example, a non-incandescent bulb having a physically similar bulb envelope and filament leads or electrical leads could be used if non-incandescent illumination is desired.

Figure 2:
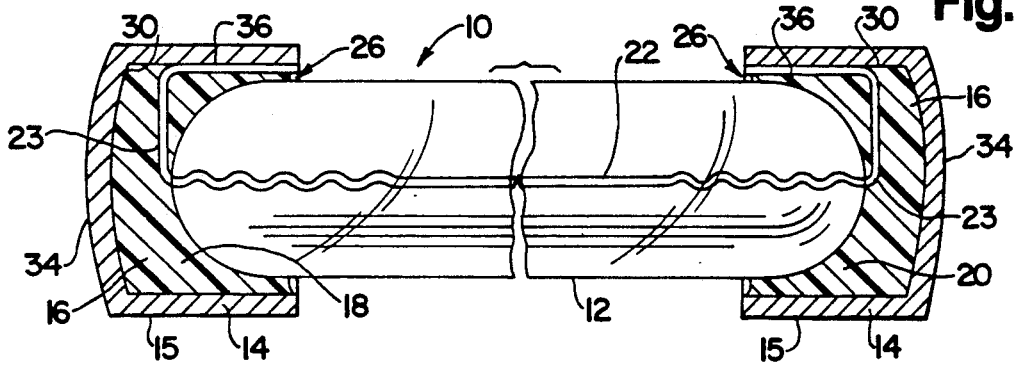
FIG. 2 is a sectional side view of the fuse lamp of FIG. 1 taken along lines 2—2 of FIG. 1.

Closed cup-shaped cylindrical metal end caps 14 are located over opposed envelope ends 18 and 20 for providing an electrical connection to bulb filament 22. Each of end caps 14 have an outer end 24 that completely covers and encloses one end of end cap 14 (see FIGS. 1–2). Thus, when end caps 14 are in position over envelope ends 18 and 20, there is no aperture permitting filament 22 to pass through end caps 14. Open ends 26 of caps 14 are generally complementary in shape to envelope ends 18 and 20 to allow envelope ends 18 and 20 to be received therein as shown in FIG. 2. The outer surface 15 of caps 14 is preferably relatively smooth and uniform to help insure good electrical contact when in operating position in an electrical socket or other connector element.

Figure 3:
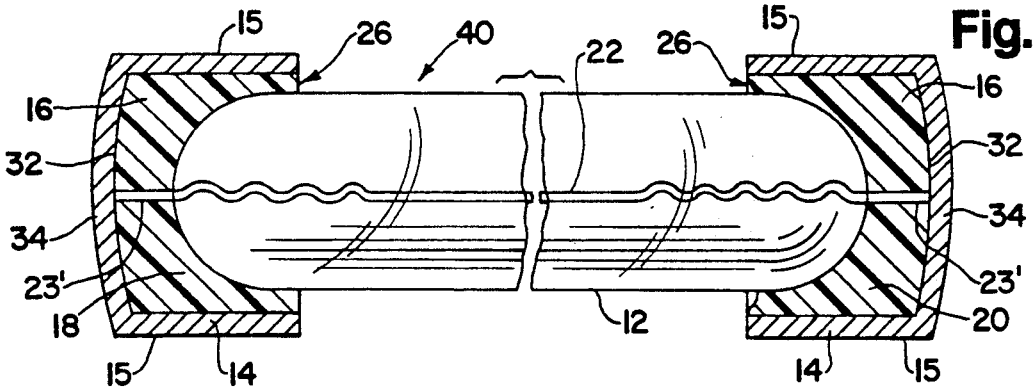
FIG. 3 is a sectional side view of another embodiment of the fuse lamp invention.
Figure 4:
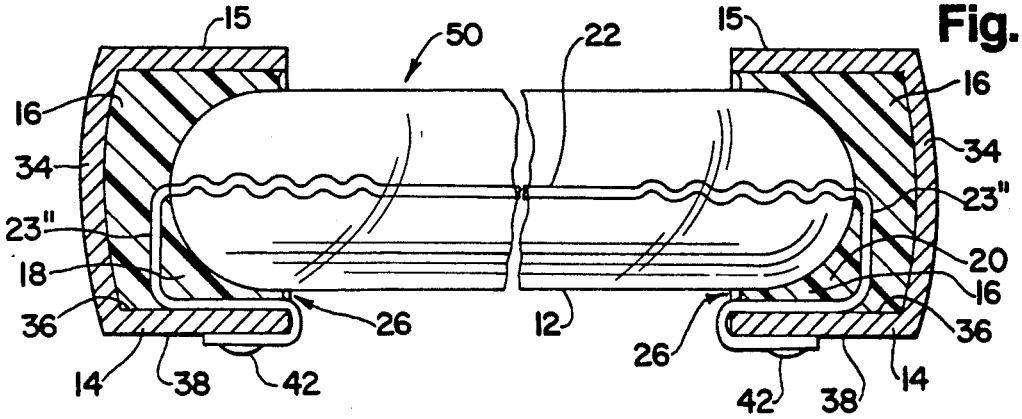
FIG. 4 is a sectional side view of still another embodiment of the fuse lamp invention.

Other embodiments in accordance with the invention, miniature lamps 40 and 50, are illustrated in FIGS. 3–4, respectively. Miniature lamps 10, 40 and 50 differ primarily in the manner in which lamp filament leads 23 are connected to end caps 14. As shown in FIG. 2, filament leads 23 extend axially from envelope ends 18 and 20. A layer of electrically conductive adhesive 16 is provided between an outer surface 28 of envelope ends 18 and 20 and an inner surface 30 of caps 14. Conductive adhesive 16 provides an electrical connection between filament leads 23 and end caps 14. Adhesive 16 also physically secures end caps 14 to envelope ends 18 and 20 and retains caps 14 thereon during normal use of lamp 10. While it is only necessary to provide enough adhesive to provide an electrical connection between filament leads 23 and end caps 14 and to secure end caps 14 to envelope ends 18 and 20, it is preferred that the volume between outer envelope surface 28 and inner cap surface 30 be filled or at least substantially filled with adhesive to enhance the physical and electrical integrity of the lamp 10. Conductive adhesive 16 can be any suitable electrically conductive adhesive material known in the art. One such suitable adhesive is the Master Bond Polymer System EP11C available from Master Bond, Inc., 154 Hobert Street, Hackensack, N.J. 07601. This adhesive is an epoxy resin adhesive in the form of a high viscosity paste that can be cured by heating to a temperature of about 300 degrees Fahrenheit for approximately 60 to 80 minutes. The physical and electrical characteristics of the adhesive are as follows:

Heat distortion temperature, °F.: >300
Tensile strength, psi: >6000
Flexural strength, psi: >8000
Elongation, %: 3
Lap shear strength, aluminum/aluminum, psi: >2350
Thermal Conductivity, Btu/hr/ft$^2$/°F./inch: 25
Surface resistance, ohms/square: approx. 1–2
Volume resistivity, ohm-cm: approx. 15

The specific orientation of filament leads 23 within adhesive 16 is not critical. While FIG. 2 shows leads 30 and 32 bent in an L-shaped configuration within caps 14 envelope ends 18 and 20, the presence of electrically conductive adhesive 16 allows leads 23 to be oriented in a random manner without significantly affecting lamp performance.

Another example of filament lead orientation is illustrated in FIG. 3 where a miniature incandescent lamp 40 is illustrated. Axially oriented filament leads 23' are directed toward and in direct contact with inner surfaces 32 of the ends 34 of cup-shaped metal end caps 14. In this embodiment it is preferred that filament leads 23' are sufficiently stiff to penetrate the adhesive 16 while uncured without bending of leads 23' when the lamp is assembled.

The embodiments of FIGS. 1-3 are advantageous because the uniform outer surface 15 of end caps 14 have no solder point thereon to disturb the uniform outer surface. Thus, a more uniform electrical contact surface is provided.

FIG. 4 illustrates still another embodiment of the invention, lamp 50. Filament leads 23" are first directed toward inner cylindrical surfaces 36 of end caps 14 and then along inner surfaces 36 toward open cap ends 26. Leads 23" are of sufficient length to protrude from beneath end caps 14, allowing leads 23' to be folded back onto outer cylindrical cap surfaces 38. Leads 23' are soldered to outer surfaces 38 of end caps 14 at solder points 42 as shown in FIG. 4. In this embodiment, since leads 23" are physically connected to end caps 14 to provide an electrical connection, adhesive 16 which physically connects end caps 14 to bulb envelope 12 can be electrically conducting or non-electrically conducting. Any suitable material for securing end caps 14 to bulb envelope 12 can be used, including various adhesives, such as silicone adhesives, epoxy adhesives and other materials known in the art.

While the invention has been described with respect to certain preferred embodiments, it is to be understood that the invention is capable of numerous changes modifications and rearrangements without departing from the invention as defined by the following claims.

What is claimed is:

1. A miniature incandescent lamp comprising:
a generally elongated bulb envelope;
a filament having an illuminating portion disposed within the envelope for providing incandescent illumination and having filament lead portions protruding from each of two generally opposed ends of the envelope for making an electrical connection to the illuminating portion of the filament;
a pair of closed metal end caps for providing connection to an electrical circuit, each of said end caps having an open end fitted over a different one of said envelope ends, thereby capturing at least a portion of the filament lead extending from each of the envelope ends generally between said end cap and said end envelope end; and
a curable electrically conductive adhesive physically connecting each end cap to its associated envelope end and electrically connecting each end cap to its captured filament lead, said curable adhesive being a paste prior to curing.

2. The lamp of claim 1 wherein said adhesive is located between an inner surface of each end cap and an outer surface of the envelope ends.

3. The lamp of claim 1 wherein the adhesive is heat curable.

4. The lamp of claim 2 wherein at least one filament lead portion physically contacts the inner surface of an end cap.

5. The lamp of claim 2 wherein neither filament lead portion physically contacts an end cap.

6. The lamp of claim 2 wherein a portion of at least one filament lead protrudes externally from between an end cap and the envelope end received therein.

7. The lamp of claim 6 wherein at least one externally protruding lead is soldered to an outer surface of the end cap from which the lead protrudes.

8. The lamp of claim 7 wherein a portion of both filament leads externally protrude from between an end cap and the envelope end received therein and wherein each protruding lead portion is soldered to an outer surface of the end cap from under which the lead protrudes.

9. The lamp of claim 1 wherein the adhesive is a curable epoxy resin.

10. A miniature incandescent lamp comprising:
a sealed cylindrical bulb envelope;
a filament having an illuminating portion axially disposed within the envelope for providing incandescent illumination and having filament lead portions protruding from each of the cylindrical envelope ends for making an electrical connection to the illuminating portion of the filament;
a pair of cylindrical metal end caps for providing connection to an electrical circuit, each end cap having an open end and fitted over a different one of said envelope ends, thereby capturing at least a portion of the filament lead extending from the envelope end generally between the end cap and the envelope end; and
a layer of heat curable electrically conductive adhesive located between an inner surface of each end cap and an outer surface of each envelope end for electrically connecting the filament leads to the end caps and for physically connecting the end caps to the envelope ends, said curable adhesive being a paste prior to heat curing.

11. The lamp of claim 10 wherein said layer of conductive adhesive substantially fills a volume located between the inner surfaces of each end cap and the outer surfaces of the envelope end covered over by each end cap.

12. The lamp of claim 10 wherein neither filament lead physically contacts an end cap.

13. The lamp of claim 10 wherein a portion of at least one filament lead protrudes externally from between the end cap and the envelope end covered by the end cap.

14. The lamp of claim 10 wherein at least one externally protruding lead is soldered to an outer surface of the fitted over end cap.

15. The lamp of claim 10 wherein a portion of both filament leads externally protrude from between an end cap and the envelope end received therein and wherein each protruding lead portion is soldered to an outer surface of the end cap from under which the lead protrudes.

16. The lamp of claim 10 wherein said disposed filament is pressed between and contacts both an inner cylindrical surface of the end cap and the cylindrical envelope outer surface.

17. The lamp of claim 10 wherein a portion of at least one filament lead is disposed between an outer cylindrical envelope surface and an inner cylindrical cap surface without extending externally from beneath the fitted over end cap.

18. The lamp of claim 17 wherein said disposed filament lead does not physically contact the envelope or the end cap.

19. A miniature lamp comprising:
bulb means for providing illumination when an electrical current is applied thereto, the bulb means including exposed electrical leads at two generally opposed ends;

metal end cap means for covering each said opposing end thereby allowing connection of the lamp to an electrical circuit; and a heat curable electrically conductive epoxy resin adhesive for providing a physical and an electrical connection between the exposed electrical leads and the end cap means and for providing a physical connection between the bulb ends and the end cap means.

* * * * *